United States Patent [19]

Barnett

[11] Patent Number: 4,793,007

[45] Date of Patent: Dec. 27, 1988

[54] SAFETY HELMET AND ADJUSTABLE LIGHT

[76] Inventor: Elben R. Barnett, P.O. Box 54, Charleston, W. Va. 25301

[21] Appl. No.: 61,977

[22] Filed: Jun. 15, 1987

[51] Int. Cl.[4] ..... A42B 1/24; A42B 3/00

[52] U.S. Cl. ..... 2/422; 2/209.2; 362/106

[58] Field of Search ..... 2/5, 6, 209.2, 422; 362/105, 106, 107

[56] References Cited

U.S. PATENT DOCUMENTS

| | | | |
|---|---|---|---|
| 515,133 | 2/1894 | Simpson | 2/209.2 |
| 1,079,251 | 11/1913 | Macrini | 2/5 X |
| 1,615,900 | 2/1927 | Brown | 2/209.2 |
| 4,090,232 | 5/1978 | Golden | 362/105 X |
| 4,530,112 | 7/1985 | Cecala et al. | 2/209.2 |

FOREIGN PATENT DOCUMENTS

| | | | |
|---|---|---|---|
| 641861 | 4/1928 | France | 362/106 |

*Primary Examiner*—Wm. Carter Reynolds
*Attorney, Agent, or Firm*—George J. Neilan

[57] ABSTRACT

An adjustable connector for attaching a light to a safety helmet, the connector enabling adjustment of the position of the light is selectively illuminate a work area for the helmet's wearer; the connector being suitable to retrofit typical existing safety helmet and light combinations. The connector has two members hinged together with one member inserted into a slot on the helmet and the other member engaging a tongue on the light.

1 Claim, 1 Drawing Sheet

SAFETY HELMET AND ADJUSTABLE LIGHT

SUMMARY OF THE INVENTION

This invention relates to a safety helmet and light combination in which the light is attached to the helmet by an adjustable connector. The connector permits the helmet wearer to adjust the position of the light to shine onto a work area selected by the wearer. The relative orientation of the light may be changed quickly by the wearer.

Safety helmets with attached lights are used in various industries, particularly in the mining industry. Typically the safety helmets used by miners are designed for a light to be clipped to the front of the helmet at the start of a shift. The light is powered by a battery pack worn on the miner's belt. At the conclusion of the shift, the light is removed from the helmet and the battery pack is recharged overnight. In the prior art, when the light is clipped to the helmet; the light is fixed relative to the helmet and cannot be adjusted. Change in the area illuminated by the light is accomplished only by the miner moving his head. This arrangement is not fully satisfactory, particularly for close-up work. The primary object of the present invention is to provide a connector mechanism that enables the wearer to adjust the light's position to illuminate a desired work area. Another object of the invention is to provide a connector which can be used in a retrofit application to change existing helmet—light units wherein the lights are in fixed position on the helmets to units with provision to adjust the position of the lights.

Conventional safety helmets have at their front above the rim a slot which receives a tongue on the light. A presently preferred embodiment of the invention comprises an adjustable connector with a first member designed to slide into the existing slots on safety helmets, a second member designed to receive the tongue of the light, and a hinge connecting the first and second members to enable adjustment of the position of the light on the helmet.

DETAILED DESCRIPTION OF THE INVENTION

Figure 2:
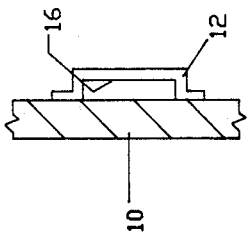
FIG. 2 is a partial cross sectional view taken on the line II—II of FIG. 1 with the connector removed.
Figure 1:
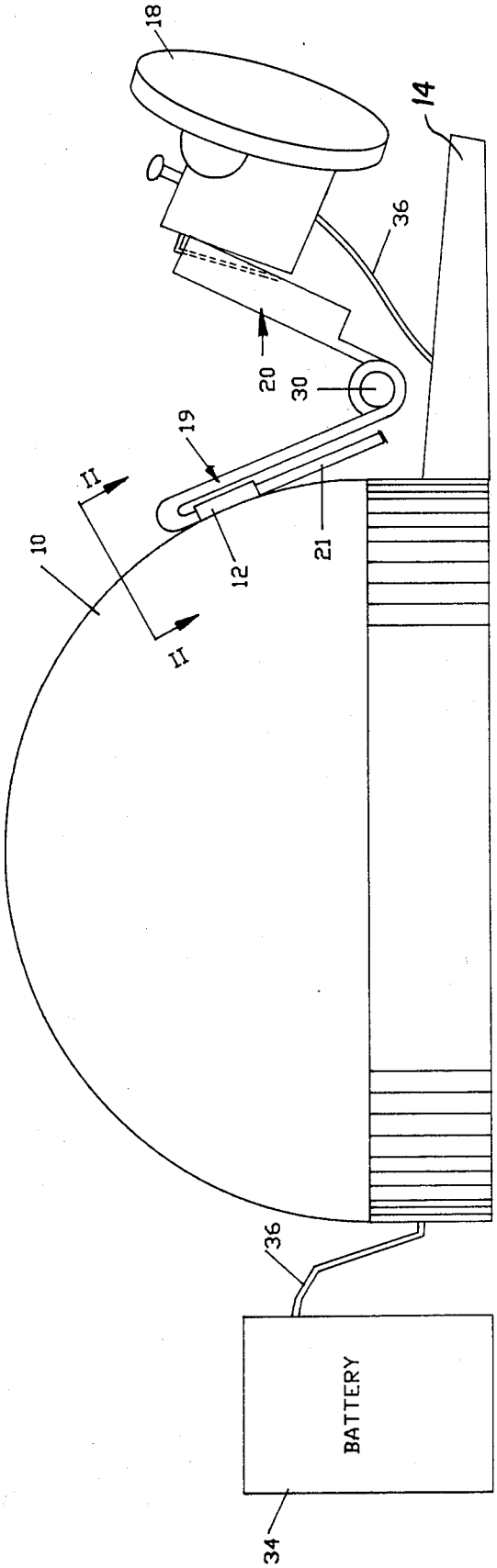
FIG. 1 is a side view of a safety helmet and adjustable light combination in accordance with a presently preferred embodiment of the invention.

Referring to the drawings and more particularly to FIG. 1, reference number 10 designates a safety helmet of the type commonly worn by miners. A metal band 12 is attached to the front of the helmet above the rim 14 and spaced from the helmet to form a slot 16 as shown in FIG. 2. It is customary to attach a light 18 directly to the helmet via slot 16.

However, in accordance with the present invention, the light 18 is attached to the helmet by cooperating connector members 19 and 20 which are hinged together.

Figure 4:
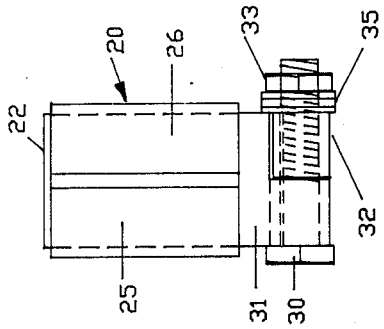
FIG. 4 is essentially a side view of the FIG. 3 connector with the connector pivoted to the dash line position of FIG. 3, and with part of the hinge in cross section.
Figure 3:
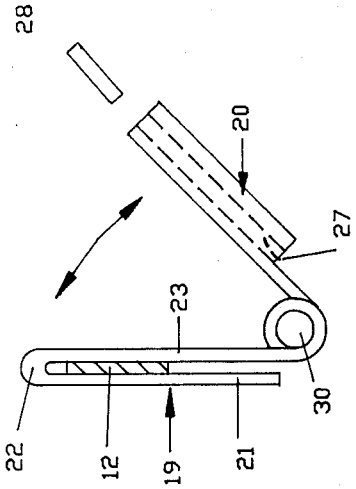
FIG. 3 is an elevational view of an adjustable connector of the invention.

As seen in FIG. 3, the first connector member 19 has a depending flange 21, a bent connecting portion 22, and a flat base portion 23 which is spaced from and generally parallel to the flange 21. Flange 21 is designed to fit snugly within the slot 16 on the helmet. The other connector member 20 has its lateral edges 25, 26 folded over through about 180 degrees to form an internal slot 27. The light 18 has a depending tongue 28 which is inserted into slot 27 to attach the light to helmet 10.

The connector members 19 and 20 are hinged together by a hinge pin or bolt 30 which extends through cylindrical hinge section 31 attached to base portion 23 of connector member 19 and through cylindrical hinge section 32 of connector member 20. A nut 33 on bolt 30 holds the hinge sections together with sufficient force to keep the connector members 19 and 20 from moving inadvertently while permitting adjustment by th wearer to selective change the light's position and consequently the area illuminated. For example, FIG. 1 shows light 18 pivoted to a downwardly directed position suitable for illuminating a work area close to the wearer and close to the ground. For normal use, the wearer might choose to pivot the connector to an upper position, following the arcuate path illustrated in FIG. 3 by arrows. The resistance provided by nut 33 will keep the light in the desired position until the wearer wishes to again change the area illuminated by light 18.

The light 18 is of standard design and is attached to a battery pack 34 by an electrical cable 36. When in use, the battery pack is customarily worn on the belt of the miner or other user. When not in use, the light is detached from the helmet and the battery pack is recharged to ready the light for the next cycle of operation.

I claim:

1. In combination with a safety helmet and a light attachable to the front of said helmet, said light being powered by a battery pack attached to a wearer, said helmet including a rim, said helmet having light supporting means including a band attached to said helmet above said rim and spaced from said helmet to provide a slot, said light having securing means suitable to attach said light to said helmet; the improvement comprising an adjustable connector for attaching said light to said helmet, said connector having a first member engaging said light support means of said helmet, said connector having a second member engaging said securing means of said light, said first member having a flange portion extending into said slot, said first member having a bent connecting portion and a base portion spaced from and generally parallel to said flange portion, said light securing means having a depending tongue, said second member having a slot to receive said tongue, and said connector having adjustment means pivotably connecting said first member and said second member to adjust the position of said light to selectively change the area illuminated whereby said light is movable from a normal upper position to a downwardly directed position suitable for illuminating a work area close to the wearer and close to the ground.

* * * * *